US005642661A

United States Patent [19]

Tu

[11] Patent Number: 5,642,661

[45] Date of Patent: Jul. 1, 1997

[54] RECYCLING/CRUSHING APPARATUS FOR CANS

[76] Inventor: Tien-Shui Tu, 74-28, Shui-Yuan Road, Shan-Ting Tsun, Ta-Liao, Hsiang, Kaohsiung, Taiwan

[21] Appl. No.: 601,517

[22] Filed: Feb. 14, 1996

[51] Int. Cl.[6] ..... B30B 9/32

[52] U.S. Cl. ..... 100/91; 100/216; 100/233; 100/902

[58] Field of Search ..... 100/45, 91, 216, 100/233, 269.2, 902

[56] References Cited

U.S. PATENT DOCUMENTS 3,792,765 2/1974 Arp ..... 100/902
4,120,240 10/1978 Smith ..... 100/902

*Primary Examiner*—Stephen F. Gerrity
*Attorney, Agent, or Firm*—Larson and Taylor

[57] ABSTRACT

A recycling/crushing apparatus for cans includes a frame housing having an inlet defined in an upper end thereof. A feeding device is mounted in the frame housing and includes an intermittently rotatable axle, a ratchet wheel mounted on the axle to rotate therewith, and a cylindrical wheel mounted on the axle to rotate therewith and having a plurality of annular recesses defined in an outer periphery thereof for receiving cans. A crushing device is mounted in the frame housing and below the feeding device and includes a fixed plate, a movable plate, and a hydraulic cylinder for actuating the movable plate to move relative to the fixed plate between a first, closed position for crushing a can therebetween and a second, open position at which a crushed can will fall. A linking device is interconnected between the movable plate and the ratchet wheel of the feeding device for urging the ratchet wheel to intermittently rotate, thereby feeding a can into the crushing device. A container is mounted below the crushing device for receiving crushed cans.

9 Claims, 4 Drawing Sheets

RECYCLING/CRUSHING APPARATUS FOR CANS

BACKGROUND OF THE INVENTION

1. Field of the Invention

The present invention relates to an apparatus for recycling and crushing cans, e.g., beverage cans.

2. Description of the Related Art

A wide variety of apparatus for recycling and crushing cans have heretofore been provided, one type of which includes a pair of rolls for crushing recycled cans by rolling, the pair of rolls having a fixed distance between two axles thereof. In order to avoid damage of the axles of the rolls, such fixed distance is relatively large for crushing cans of various sizes, and, accordingly, the crushed cans cannot be reduced to minimized volumes. A further type of recycling and crushing apparatus for cans uses motor-driven punching means to crush cans longitudinally, yet falling of the cans for consecutive crushing is not properly controlled. Furthermore, thicknesses of the crushed cans are not uniform, resulting in trouble in subsequent handling. The present invention is intended to provide an improved recycling/crushing apparatus to mitigate and/or obviate the above problems.

SUMMARY OF THE INVENTION

A recycling/crushing apparatus for cans in accordance with the present invention includes a frame housing having an inlet defined in an upper end thereof and a feeding means mounted in the frame housing and below the inlet and including an intermittently rotatable axle, a ratchet wheel mounted on the axle to rotate therewith, and a cylindrical wheel mounted on the axle to rotate therewith and having a plurality of annular recesses defined in an outer periphery thereof for receiving cans.

A crushing means is mounted in the frame housing and below the feeding means and includes a fixed plate, a movable plate, and means for actuating the movable plate to move relative to the fixed plate between a first, closed position for crushing a can therebetween and a second, open position at which a crushed can will fall. A linking means is interconnected between the movable plate and the ratchet wheel of the feeding means, whereby rotation of the ratchet wheel is prohibited when the movable plate is in the first, closed position, and when the movable plate is moved from the first, closed position to the second, open position, the ratchet wheel rotates through a pre-determined angle via transmission of the linking means, thereby feeding a can in one of the recesses of the cylindrical wheel into a place defined between the movable plate and the fixed plate for subsequent crushing. A container is mounted below the crushing means for receiving crushed cans.

In accordance with one aspect of the invention, the means for actuating the movable plate is a hydraulic cylinder having a piston rod securely connected to and thus actuate the movable plate, and the movable plate is connected to a pivoted arm to provide a reliable support.

In accordance with a further aspect of the invention, the movable plate includes a hole for receiving a spring therein, and the linking means includes a rod interconnected between the ratchet wheel of the feeding means and the movable plate of the crushing means. The rod includes a pin at a first end thereof and movable in the hole. The rod further includes a second end connected to the ratchet wheel, whereby when the movable plate moves from the first, closed position to the second, open position, the first end of the rod moves downwardly to compress the spring in the hole while the ratchet wheel is urged to rotate through the pre-determined angle.

In a preferred embodiment of the present invention, a first container is mounted below the crushing means for receiving non-magnetic crushed cans, a second container is mounted adjacent to the first container for receiving magnetic crushed cans, and a magnetic means mounted above the second container for guiding magnetic crushed cans into the second container. Preferably, a separation plate is mounted between the first and second containers and has an upper end which slightly inclines toward the magnetic means for guiding a non-magnetic crushed can to fall into the first container for non-magnetic cans.

Other objects, advantages, and novel features of the invention will become more apparent from the following detailed description when taken in conjunction with the accompanying drawings.

DESCRIPTION OF THE PREFERRED EMBODIMENT

Figure 1:
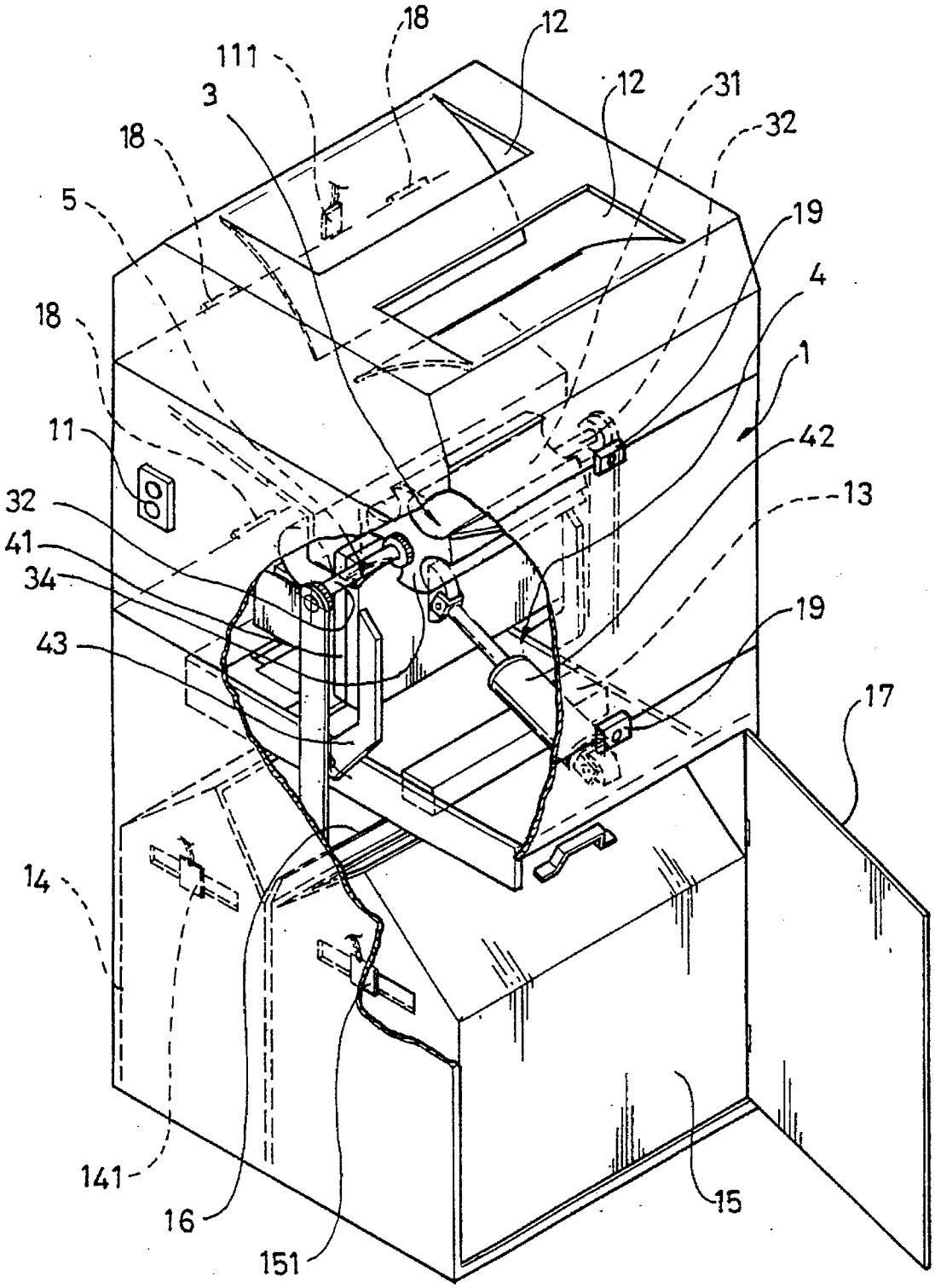
FIG. 1 is a perspective view of a recycling/crushing apparatus for cans in accordance with the present invention.
Figure 3:
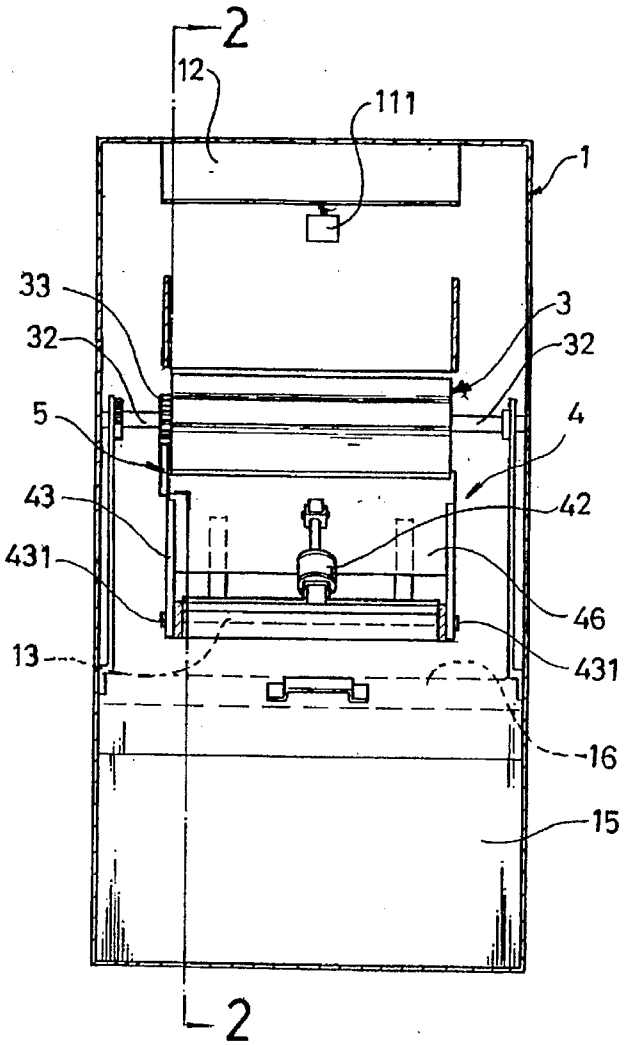
FIG. 3 is a cross-sectional view, taken along line 3—3 of FIG. 2, of the recycling/crushing apparatus for cans in accordance with the present invention.
Figure 2:
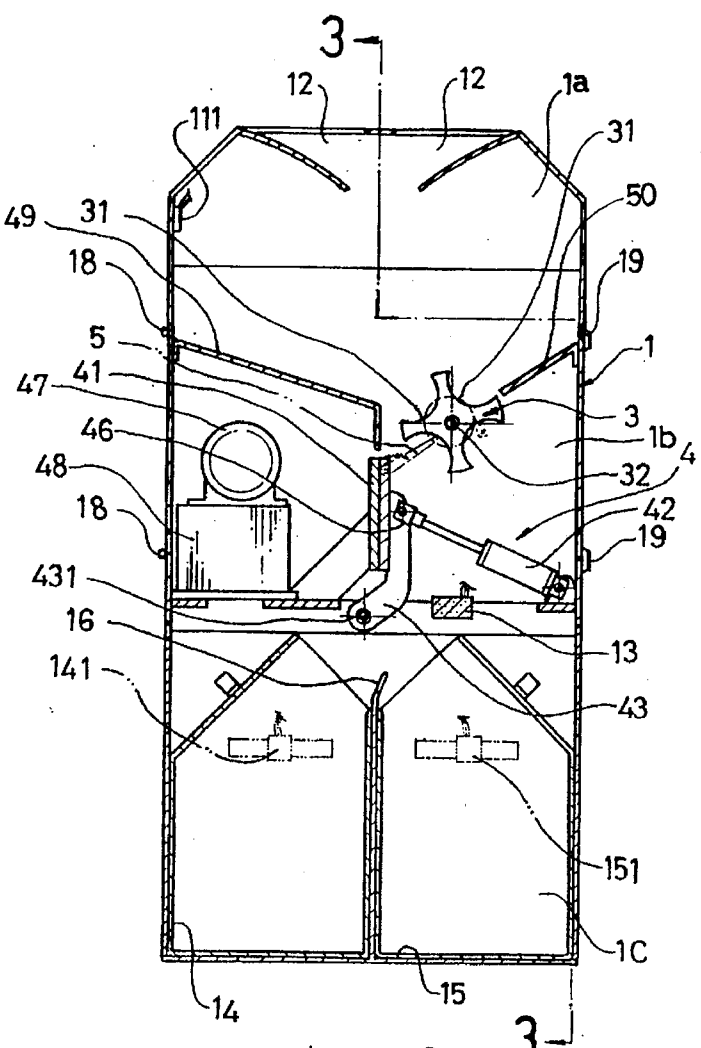
FIG. 2 is a cross-sectional view, taken along line 2—2 of FIG. 3, of the recycling/crushing apparatus for cans in accordance with the present invention.

Referring to the drawings and initially to FIGS. 1 to 3, a recycling/crushing apparatus in accordance with the present invention generally includes a frame housing 1, a feeding means 3, a crushing means 4, and a linking means 5. As shown in FIG. 2, the frame housing 1 generally includes an upper compartment 1*a*, a mediate compartment 1*b*, and a lower compartment 1*c* therein. The frame housing 1 includes a pair of spaced feeding inlets 12 defined in an upper side thereof through which cans to be recycled and crushed pass to the upper compartment 1*a*. A power switch 11 and a detecting means 111 are mounted to the frame housing 1. When the detection means 111 detects that the cans entering the recycling/crushing apparatus reach a pre-determined quantity, the crushing means 4 is activated to proceed with crushing of the cans, which will be described in detail later.

The feeding means 3 is mounted between the upper compartment 1*a* and the mediate compartment 1*b* (see FIG. 2) and includes an intermittently rotatable axle 32 and a cylindrical wheel 34 mounted on the axle 32 to rotate therewith and having a plurality of annular recesses 31 defined in an outer periphery thereof (see FIGS. 1 and 2) for receiving cans. Intermittent rotation of the axle 32 and the cylindrical wheel 34 thereon is controlled by the linking means 5, which will be described in detail later.

Still referring to FIGS. 1 to 3, the crushing means 4 includes a fixed plate 41, a movable plate 46, and a hydraulic cylinder 42 having a piston rod (not labeled) securely attached to and thus actuating the movable plate 46. An interior housing 49 (see FIG. 2) is provided in the mediate compartment 1*b* to enclose a tank 48 containing working fluid for the hydraulic cylinder 42 and a driving means 47, such as a motor or pump for actuating the hydraulic cylinder 42. As shown in FIG. 2, the movable plate 46 is connected to an arm 43 which, in turn, is pivotally mounted at a point 431 to provide a reliable support, such that the movable plate 46 moves with respect to the fixed plate 41 and about the point 431. The movable plate 46 is movable between a first, closed position (see FIG. 4) at which a can between the fixed plate 41 and the movable plate 46 is crushed and a second, open position (see FIG. 5) at which the crushed can fall (which will be further described in detail later) and at which an uncrushed can falls to a position held between the fixed plate 41 and the movable plate 46 from the feeding means 3 which rotates through a predetermined angle.

Figure 5:
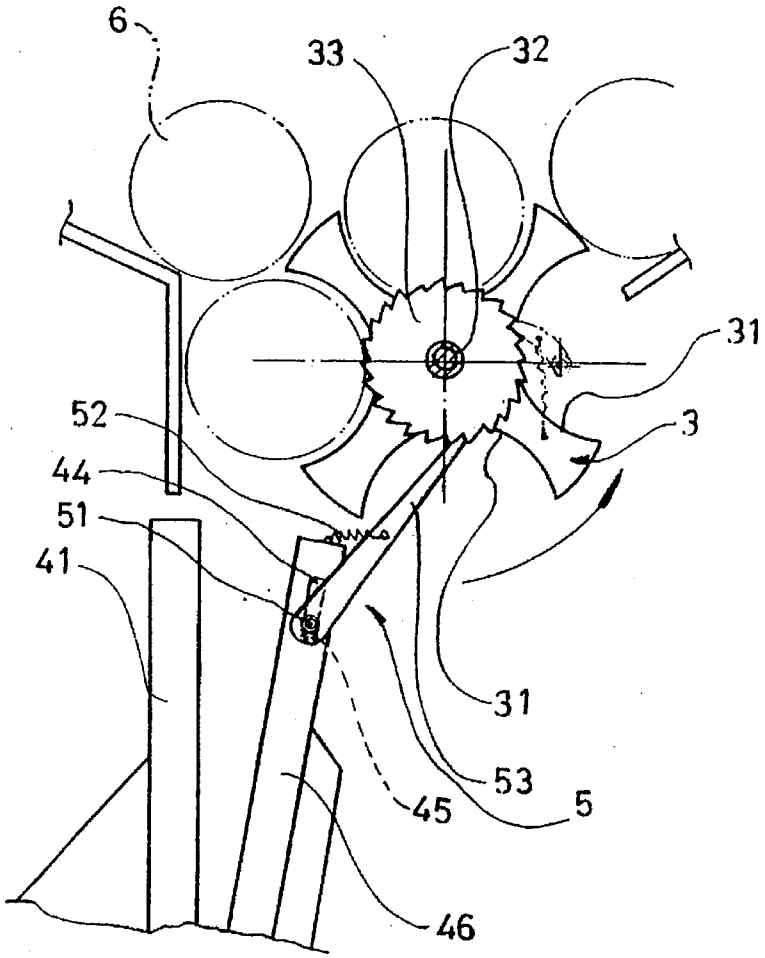
FIGS. 4 and 5 are schematic views illustrating feeding of cans of the recycling/crushing apparatus in accordance with the present invention.
Figure 4:
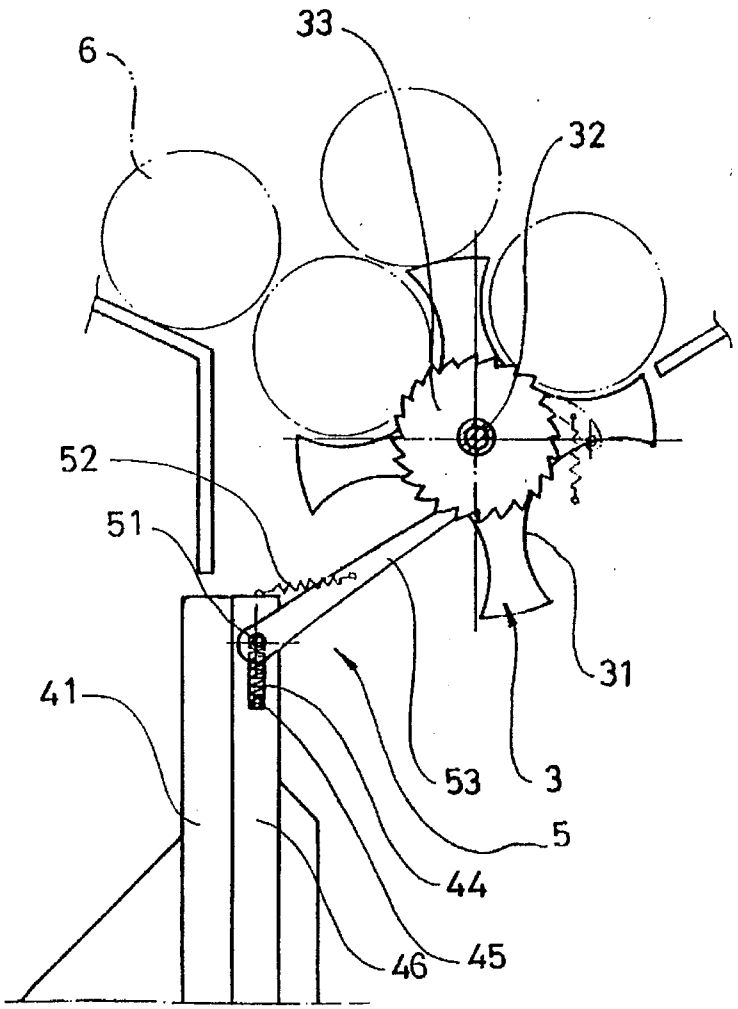
Figure 6:
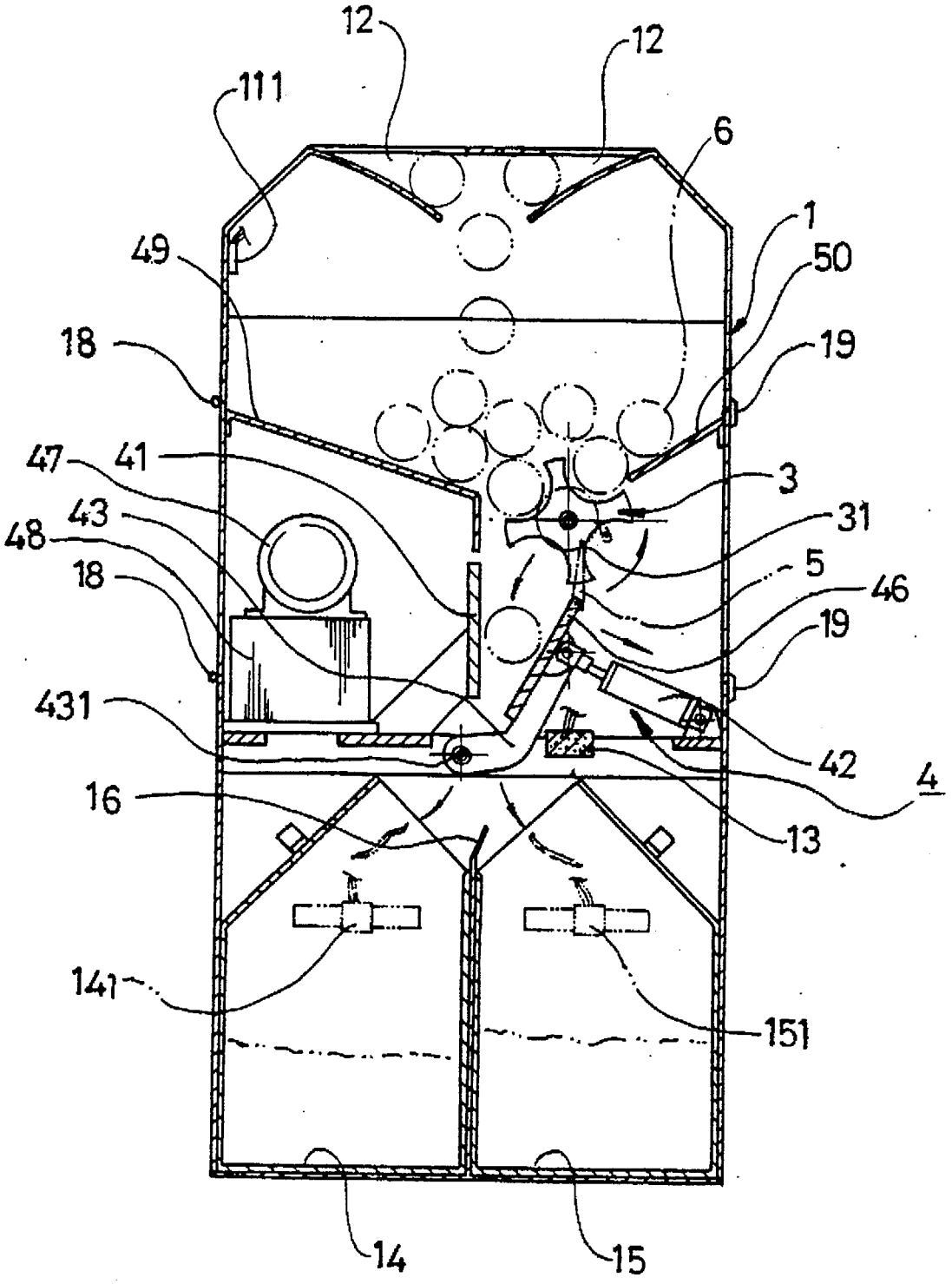
FIG. 6 is a cross-sectional view illustrating operation of the recycling/crushing apparatus in accordance with the present invention.

Referring to FIGS. 4 and 5, the linking means 5 is substantially a rod 53 interconnected between the feeding means 3 and the movable plate 46 of the crushing means 4. The movable plate 46 includes a hole 44 defined therein in which a spring 45 is received. The rod 53 includes a pin 51 at a first end thereof and movable in the hole 44. A second end of the rod 53 is connected to a ratchet wheel 33 which, in turn, is fixedly mounted on the axle 32 to rotate therewith. When the movable plate 46 moves from the first, closed position shown in FIG. 4 to the second, open position shown in FIG. 5, the first end of the rod 51 moves downwardly to compress the spring 45 in the hole 44 while the ratchet wheel 33 is urged to rotate through the pre-determined angle mentioned above. Thus, a can 6 received in one of the recesses 31 of the feeding means 3 falls for subsequent crushing. The recess 31 is sized to receive only one can. In addition, as shown in FIG. 6, the interior housing 49 and a restraining plate 50 mounted in the frame housing 1 further assures that only one can is fed into the crushing means 4 upon each rotation of the ratchet wheel 33 (which causes rotation of the axle 32). When the movable plate 46 moves from the open position to the closed position, the can 6 is crushed and the rod 5 is moved to the position shown in FIG. 4 under the action of the spring 45 to avoid further rotation of the ratchet wheel 33. It is appreciated that a second spring 52 is interconnected between an upper end of the movable plate 46 and a mediate portion of the rod 53 so that the second end of the rod 53 always contacts the ratchet wheel 33.

Referring to FIG. 2, a first container 14 and a second container 15 are received in the lower compartment and spaced by an upright separation plate 16 disposed therebetween. A magnetic means 13 is mounted between the mediate compartment 1*b* and the lower compartment 1*c* and is located above the second container 15 such that, if the crushed can is magnetic, it falls into the second container 15 under the action of magnetic force. If the crushed can is non-magnetic, it falls into the first container 14 under the action of gravity. Preferably, an upper end of the separation plate 16 slightly inclines toward the magnetic means 13 for guiding a non-magnetic crushed can to fall into the first container for non-magnetic cans, e.g., the non-magnetic crushed can may fall to and thus collide with the upper end of the separation plate 16 and then fall into the first container 14 for non-magnetic cans. A second detection means 141 is mounted in the first container 14 such that when the latter is full, the former will send a signal to indicate that the first container 14 is full and stop the recycling/crushing apparatus. Similarly, a third detection means 151 is mounted in the second container 15 such that when the latter is full, the former will send a signal to indicate that the second container 15 is full and stop the recycling/crushing apparatus. The frame housing 1 further includes a normally closed door 17 (see FIG. 1) which can be opened for removal of the crushed cans when either one of the first and second containers 14 and 15 are full. Preferably, hinges 18 and latches 19 are provided to the frame housing 1 for maintenance. It is appreciated that the frame housing 1 may have only one container provided in the lower compartment for receiving crushed cans if further classification is not required, while the magnetic means 13 is omitted.

According to the above description, it is appreciated that the feeding of the cans is precisely controlled and the cans crushed by the recycling/crushing apparatus of the present invention may have a uniform thickness.

Although the invention has been explained in relation to its preferred embodiment, it is to be understood that many other possible modifications and variations can be made without departing from the spirit and scope of the invention as hereinafter claimed.

What is claimed is:

1. A recycling/crushing apparatus for cans comprising:

a frame housing having an inlet defined in an upper end thereof;

a feeding means mounted in the frame housing and below the inlet and including an intermittently rotatable axle, a ratchet wheel mounted on the axle to rotate therewith, and a cylindrical wheel mounted on the axle to rotate therewith and having a plurality of annular recesses defined in an outer periphery thereof for receiving cans;

a crushing means mounted in the frame housing and below the feeding means and including a fixed plate, a movable plate, and means for actuating the movable plate to move relative to the fixed plate between a first, closed position for crushing a can therebetween and a second, open position at which a crushed can will fall;

a linking means interconnected between the movable plate and the ratchet wheel of the feeding means, whereby rotation of the ratchet wheel is prohibited when the movable plate is in the first, closed position, and when the movable plate is moved from the first, closed position to the second, open position, the ratchet wheel rotates through a pre-determined angle via transmission of the linking means, thereby feeding a can in one of the recesses of the cylindrical wheel into a place defined between the movable plate and the fixed plate for subsequent crushing; and a container mounted below the crushing means for receiving crushed cans.

2. The recycling/crushing apparatus as claimed in claim 1, wherein the means for actuating the movable plate is a hydraulic cylinder having a piston rod securely connected to and thus actuate the movable plate.

3. The recycling/crushing apparatus as claimed in claim 2, further comprising a pivoted arm to which the movable plate is connected.

4. The recycling/crushing apparatus as claimed in claim 1, wherein the movable plate includes a hole, a spring being received in the hole, and the linking means including a rod interconnected between the ratchet wheel of the feeding means and the movable plate of the crushing means, the rod including a pin at a first end thereof and movable in the hole, the rod further including a second end connected to the ratchet wheel, whereby when the movable plate moves from the first, closed position to the second, open position, the first end of the rod moves downwardly to compress the spring in the hole while the ratchet wheel is urged to rotate through the pre-determined angle.

5. A recycling/crushing apparatus for cans comprising:

a frame housing having an inlet defined in an upper end thereof;

a feeding means mounted in the frame housing and below the inlet and including an intermittently rotatable axle, a ratchet wheel mounted on the axle to rotate therewith, and a cylindrical wheel mounted on the axle to rotate therewith and having a plurality of annular recesses defined in an outer periphery thereof for receiving cans;

a crushing means mounted in the frame housing and below the feeding means and including a fixed plate, a movable plate, and means for actuating the movable plate to move relative to the fixed plate between a first, closed position for crushing a can therebetween and a second, open position at which a crushed can will fall;

a linking means interconnected between the movable plate and the ratchet wheel of the feeding means, whereby rotation of the ratchet wheel is prohibited when the movable plate is in the first, closed position, and when the movable plate is moved from the first, closed position to the second, open position, the ratchet wheel rotates through a pre-determined angle via transmission of the linking means, thereby feeding a can in one of the recesses of the cylindrical wheel into a place defined between the movable plate and the fixed plate for subsequent crushing;

a first container mounted below the crushing means for receiving non-magnetic crushed cans and a second container mounted adjacent to the first container for receiving magnetic crushed cans; and a magnetic means mounted above the second container for guiding magnetic crushed cans into the second container.

6. The recycling/crushing apparatus as claimed in claim 5, wherein the means for actuating the movable plate is a hydraulic cylinder having a piston rod securely connected to and thus actuate the movable plate.

7. The recycling/crushing apparatus as claimed in claim 6, further comprising a pivoted arm to which the movable plate is connected.

8. The recycling/crushing apparatus as claimed in claim 5, wherein the movable plate includes a hole, a spring being received in the hole, and the linking means including a rod interconnected between the ratchet of the feeding means and the movable plate of the crushing means, the rod including a pin at a first end thereof and movable in the hole, the rod further including a second end connected to the ratchet wheel, whereby when the movable plate moves from the first, closed position to the second, open position, the first end of the rod moves downwardly to compress the spring in the hole while the ratchet wheel is urged to rotate through the pre-determined angle.

9. The recycling/crushing apparatus as claimed in claim 5, further comprising a separation plate mounted between the first and second containers and having an upper end slightly inclined toward the magnetic means for guiding a non-magnetic crushed can to fall into the first container for non-magnetic cans.

* * * * *